US010791828B1

(12) United States Patent
Ryan

(10) Patent No.: US 10,791,828 B1
(45) Date of Patent: Oct. 6, 2020

(54) STOWABLE STAND

(71) Applicant: Classic Home & Garden, LLC., Monroe, CT (US)

(72) Inventor: Fred Joseph Ryan, Trumbull, CT (US)

(73) Assignee: CLASSIC HOME & GARDEN, LLC, Monroe, CT (US)

( * ) Notice: Subject to any disclaimer, the term of this patent is extended or adjusted under 35 U.S.C. 154(b) by 0 days.

(21) Appl. No.: 16/531,777

(22) Filed: Aug. 5, 2019

(51) Int. Cl.
*A47B 43/00* (2006.01)
*A47G 7/04* (2006.01)
*A47F 5/06* (2006.01)

(52) U.S. Cl.
CPC ..... *A47B 43/00* (2013.01); *A47F 5/06* (2013.01); *A47G 7/045* (2013.01)

(58) Field of Classification Search
CPC ..... A47B 43/00; A47G 25/0664; A47G 25/0685; A47G 7/045; A47F 5/04; A47F 5/06
USPC ..... 211/196, 205
See application file for complete search history.

(56) References Cited

U.S. PATENT DOCUMENTS 763,041 A * 6/1904 Braten ..... A47G 25/28 223/88
896,990 A * 8/1908 Hill ..... F16M 11/00 248/125.3
1,243,173 A * 10/1917 Hinckley ..... A47G 25/12 211/62
1,754,998 A * 4/1930 Geartts ..... A47F 3/14 211/85.4
2,092,691 A * 9/1937 Berghoff ..... A47F 5/04 211/74
2,438,886 A * 4/1948 Belmont ..... A47K 10/12 211/106.01
2,604,214 A * 7/1952 Fussell ..... A47F 7/24 211/207
2,650,717 A * 9/1953 Larson ..... A47F 5/04 211/196
2,684,225 A * 7/1954 Johnson ..... A47G 25/08 248/213.1
3,044,630 A * 7/1962 Szabo ..... A47G 25/0621 211/119.004
3,638,585 A * 2/1972 Futrell ..... A47B 19/00 108/9

(Continued)

FOREIGN PATENT DOCUMENTS

DE 3205283 A1 * 8/1983 ..... A47F 5/06
DE 9116070 U1 * 3/1992 ..... A47F 7/24

(Continued)

*Primary Examiner* — Stanton L Krycinski
(74) *Attorney, Agent, or Firm* — Tutunjian & Bitetto, P.C.

(57) ABSTRACT

A stowable stand includes elongated stand members, the stand members having a shape to permit nesting in a two dimensional configuration. Each stand member includes an extension end portion extending from a corresponding longitudinal portion. The longitudinal portions being hingedly connected to another longitudinal portion to permit the elongated stand members to fold flat into a stowable position. Each stand member includes a support portion extending from the longitudinal portion on an end opposite the extension end portion, the support portions collectively forming a support stand to support the stowable stand when the elongated stand members are in a support position.

20 Claims, 9 Drawing Sheets

(56) References Cited

U.S. PATENT DOCUMENTS 3,807,574 A * 4/1974 Lanza ..... A47F 5/06 211/207
4,253,578 A * 3/1981 Rekow ..... A47F 5/04 211/204
4,721,212 A * 1/1988 Lowe ..... A47G 25/0685 16/223
4,770,303 A * 9/1988 Boyd ..... A47G 7/042 211/118
4,932,540 A * 6/1990 Pfeifer ..... A47F 5/04 211/193
5,037,049 A * 8/1991 Funk ..... A47F 5/01 248/165
5,234,115 A * 8/1993 Lin ..... F24B 1/199 211/196
5,333,828 A * 8/1994 Severeid ..... A47G 33/12 248/167
5,509,545 A * 4/1996 Banke ..... A47G 25/0671 211/205
D373,492 S * 9/1996 Stanley ..... D6/680.3
5,873,195 A * 2/1999 Wortham ..... A47G 7/042 211/207
6,012,591 A * 1/2000 Brandenberg ..... A47B 9/14 211/26
6,050,427 A * 4/2000 Loveland ..... E05D 11/00 211/119.004
6,196,398 B1 * 3/2001 Lowe ..... A47B 61/003 211/87.01
6,712,228 B2 * 3/2004 Lowe ..... A47B 49/00 211/119.004
6,722,511 B1 * 4/2004 Lowe ..... A47F 5/0838 211/119.004
7,311,289 B2 * 12/2007 Mori ..... A47B 21/045 248/165
7,631,773 B1 * 12/2009 Calabrisotto ..... A47B 61/00 211/196
9,560,927 B2 * 2/2017 Krumpe ..... A47G 25/0607
10,016,077 B1 * 7/2018 Carney ..... A47G 7/044
2007/0272642 A1 * 11/2007 Baptiste ..... A47B 43/00 211/201
2008/0078732 A1 * 4/2008 Hsu ..... A47B 43/00 211/186
2011/0062093 A1 * 3/2011 McGhee ..... A47B 43/00 211/50
2018/0249825 A1 * 9/2018 Wang ..... A47F 5/04

FOREIGN PATENT DOCUMENTS

FR 374288 A * 6/1907 ..... A47F 5/06
FR 797498 A * 4/1936 ..... A47F 5/04
FR 1435952 A * 4/1966 ..... A47G 25/0664
FR 1455102 A * 10/1966 ..... A47G 25/0664
FR 1582968 A * 10/1969 ..... F21V 21/26
FR 2499389 A1 * 8/1982 ..... A47F 5/06
GB 739945 A * 11/1955 ..... A47F 5/06
GB 1206942 A * 9/1970 ..... A47G 25/0664

* cited by examiner

STOWABLE STAND

BACKGROUND

Technical Field

The present invention relates to a stand, and more particularly to a stowable multi-hook stand.

Description of the Related Art

Hanging baskets can be used to grow plants. Hanging baskets can be hung from hooks attached to awnings and building. Hanging baskets give users more space to grow plants when they do not have floor space or yards to grow plants. Users in apartments can use hanging baskets on balconies or hung from the ceiling to grow gardens when they do not have a yard available for gardening.

SUMMARY

According to embodiments of the present invention, a stowable stand is described. The stowable stand includes a plurality of elongated stand members, the stand members having a shape to permit nesting in a two-dimensional configuration, each stand member including an extension end portion extending from a corresponding longitudinal portion, the longitudinal portions being hingedly connected to at least one other longitudinal portion to permit the elongated stand members to fold flat into a stowable position in the two-dimensional configuration, and each stand member including a support portion extending from the longitudinal portion on an end opposite the extension end portion, the support portions collectively forming a support stand to support the stowable stand when the elongated stand members are in a standing position.

According to other embodiments, a stowable stand is described. A stowable stand includes a plurality of stand members extending away from a central axis ending in a hook, each of the plurality of stand members including a base extension at the end opposite the hook, a link that connects each of the plurality of stand members to at least one other of the plurality of stand members, a locking mechanism that locks two of the plurality of members together to keep the stowable stand in a locked state, and the base extensions collectively forming a stand base to support the stowable stand when the stand members are in the locked state.

According to embodiments of the present invention, a collapsible stowable stand is described. The collapsible stowable stand includes a plurality of extendible elongated stand members, the stand members having a shape to permit nesting in a two dimensional configuration, each stand member including an foldable extension end portion extending from a corresponding extendible longitudinal portion, the extendible longitudinal portion being extendible from a fixed longitudinal portion, the fixed longitudinal portions being hingedly connected to at least one other fixed longitudinal portion to permit the extendible elongated stand members to fold flat into a stowable position, and each stand member including a support portion extending from the fixed extendible longitudinal portion on an end opposite the extendible longitudinal portion, the support portions collectively forming a support stand to support the stowable stand when the extendible elongated stand members are in a standing position.

These and other features and advantages will become apparent from the following detailed description of illustrative embodiments thereof, which is to be read in connection with the accompanying drawings.

BRIEF DESCRIPTION OF THE SEVERAL VIEWS OF THE DRAWINGS

The disclosure will provide details in the following description of preferred embodiments with reference to the following figures wherein.

DETAILED DESCRIPTION

Figure 1:
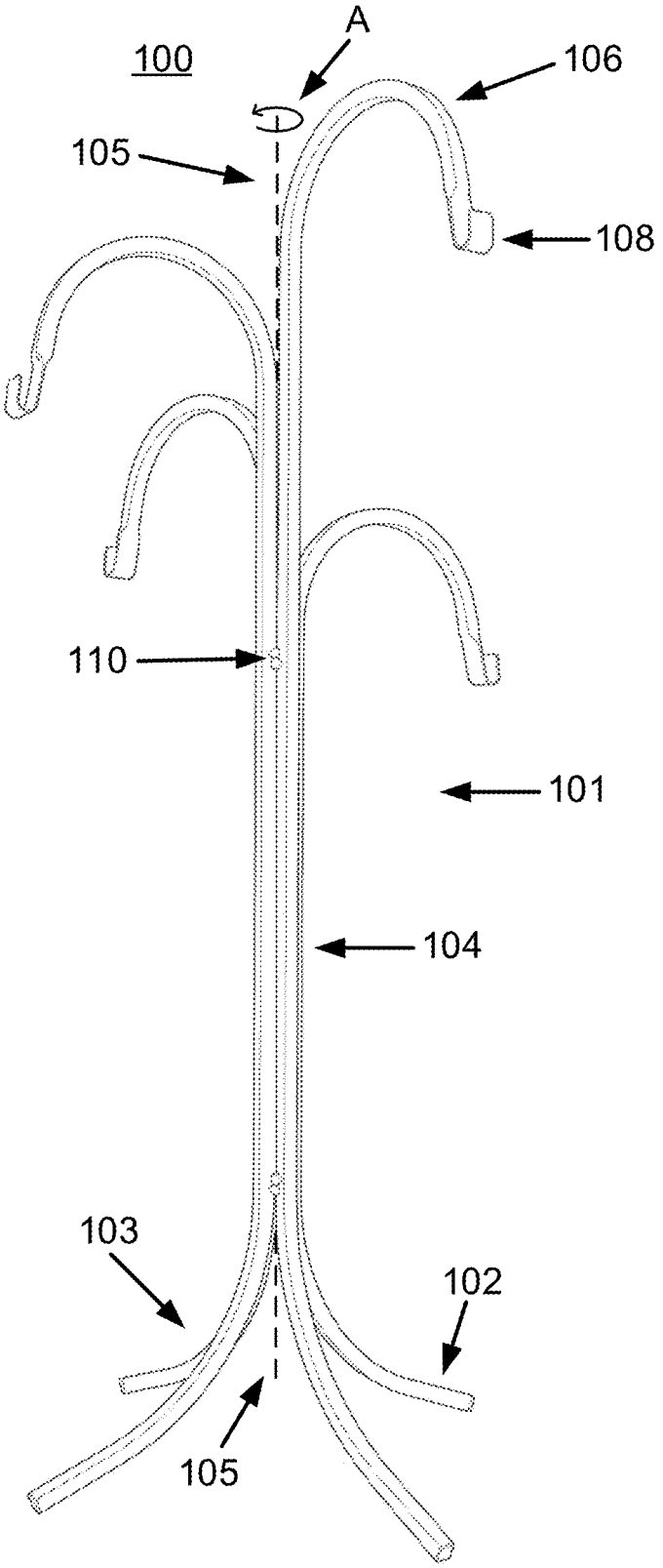
FIG. 1 is a side view of a stowable stand in a locked position with hinges in accordance with an embodiment.

Embodiments and aspects of a stowable stand are described. A stowable stand can be used to effectively grow plants in spaces that would not normally be conducive to growing plants. The stowable stand can be employed with hanging baskets to grow plants or store other things. The stowable stand can have a folded or stowed position and a standing or locked position. The stowable stand can have multiple hingedly connected elongated stand members with hangers or other end pieces at one end of the elongated stand members. The hingedly connected elongated stand members of the stowable stand permit the multiple elongated stand members of the stowable stand to nest flatly into the folded or stowed position. The folded or stowed position of the stowable stand permits a more compact item to ship, store, and transport.

The orientation of the stowable stand in the standing or locked position with the elongated stand members around a central axis and the bottom of the elongated stand members forming a base permits the hanger or other end piece on one side to counter balance any torsional force the hanger or other end price on the opposite side applies across the stowable stand and to the base. The counter balance design of the stowable stand permits the stowable stand to remain standing when heavy objects are hung from the hangers or other end pieces.

The hangers can extend perpendicularly from the elongated stand member away from the central axis to varying lengths, as long as the counter balance is maintained. The elongated stand members can have one hanger or multiple hangers. In one embodiment, one elongated stand member can have a hanger extending farther than other hangers, creating more torsional force, but the counter balance can be maintained with having an elongated stand member with two hangers extending a shorter distance from the central axis.

The stowable stand can be held in the standing or locked position with a locking mechanism. The locking mechanism can be integrated, partially integrated, or separate from the stowable stand. The lower portion of the elongated stand members can form a base when the stowable stand is in the locked or standing position. The base can hold the stowable stand upright while in the standing or locked position. The formation of the base while the stowable stand is in the standing or locked position increases the stowable stands stability against being toppled with torsional loads on the hangers.

The stowable stand in accordance with embodiments of the present invention may be fabricated by molding processes using plastics; however, other materials are contemplated as well. For example, the stowable stand may include metal construction, wood, etc. In one embodiment, the elongated stand members of the stowable stand are a monolithic construction (e.g., one piece).

It is to be understood that the present invention will be described in terms of a given illustrative architectures; however, other architectures, structures, materials and process features and steps may be varied within the scope of the present invention.

It will also be understood that when an element such as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

The terminology used herein is for the purpose of describing particular embodiments only and is not intended to be limiting of example embodiments. As used herein, the singular forms "a," "an" and "the" are intended to include the plural tones as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components a d/or ups thereof.

Spatially relative terms, such as "beneath," "below," "lower," "above," "upper," and the like, may be used herein for ease of description to describe one element's or feature's relationship to another ent(s) or feature(s) as illustrated in the FIGs. It will be understood that the spatially relative to s are intended to encompass different orientations of the device in use or operation in addition to the orientation depicted in the FIGs. For example, if the device in the FIGs. is turned over, elements described as "below" or "beneath" other elements or features would then be oriented "above" the other elements or features. Thus, the term "below" can encompass both an orientation of above and below. The device may be otherwise oriented (rotated 90 degrees or at other orientations), and the spatially relative descriptors used herein may be interpreted accordingly. In addition, it will also be understood that when a layer is referred to as being "between" two layers, it can be the only layer between the two layers, or one or more intervening layers may also be present.

It will be understood that, although the terms first, second, etc. may be used herein to describe various elements, these elements should not be limited by these terms. These terms are only used to distinguish one element from another element. Thus, a first element discussed below could be termed a second element without departing from the scope of the present concept.

Referring now to the drawings in which like numerals represent the same or similar elements and initially to FIG. 1, a stowable stand 100 in the locked position with elongated stand member hinges 110 is shown in accordance with embodiments of the present inventions.

According to aspects of the present embodiment, the stowable stand 100 can include a plurality of elongated stand members 101. The plurality of elongated stand members 101 can be in the standing or locked position around a central axis 105 and a stowable or folded position. The plurality of elongated stand members 101 can be opened in a rotational direction of indicating arrow "A" along the central axis 105. In one embodiment, the stowable stand 100 can include four elongated stand members 101. In other embodiments, the stowable stand 100 can include, for example, e.g., three elongated stand members 101, five elongated stand members 101, six elongated stand members 101, seven elongated stand members 101, etc. The elongated stand members 101 can be constructed from a solid material or tubular material. In one embodiment, the elongated stand members 101 can include a tubular construction with a square cross section. In another embodiment, the elongated stand members 101 can include other tubular cross sections, for example, e.g., a circular cross section, an octagonal cross section, a hexagonal cross section, etc. The elongated stand members 101 can be constructed of solid material with varying cross sections, for example, e.g., a solid square cross section, a solid circular cross section, a solid square twisted cross section, etc. The elongated stand members 101 can include a support portion 103 near one end of the elongated stand member 101. In one embodiment, the support portion 103 can be a gentle extension end portion away from the elongated stand member 101. In other embodiments, the support portion 103 can include a sharp corner, for example, the corner being from, for example, e.g., about 15 degrees to about 75 degrees. The elongated stand member 101 can form a base 102 extending from the support portion 103.

The base 102 extends away from the support portion 103 to support the stowable stand 100 and keep the stowable stand 100 in the upright position. In one embodiment, the base 102 can extend away from the support portion 103 from, for example, e.g., about 4 inches to about 24 inches. In another embodiment, the base 102 can extend away from the support portion 103 for, for example, e.g., about 10 inches to about 14 inches. The elongated stand member 101 can include a longitudinal portion 104 extending from the support portion 101 opposite the base 102. In one embodiment, the longitudinal portion 104 can extend from the support portion 103 from, for example, e.g., about 15 inches to about 100 inches. In another embodiment, the longitudinal portion 104 can extend from the support portion 103 from, for example, e.g., about 30 inches to about 60 inches. Each of the plurality of elongated stand members 101 in the stowable stand 100 can include the longitudinal portion 104 of different lengths. In one embodiment, the longitudinal portion 104 of each of the plurality of elongated stand members 101 extends, for example, e.g., about 10 inches further from the support portion 103 as the previous elongated stand member 101.

The elongated stand member 101 can include an extension end portion 106 at the end of the longitudinal portion 104 opposite the support portion 103. The extension end portion 106 can extend in the same direction away from the longitudinal portion 104 as the support portion 103. The extension end portion 106 can extension end portion from, for example, e.g., about 150 degrees to about 180 degrees from the longitudinal portion. In one embodiment, the extension end portion 106 can extend away from the longitudinal portion 104 by, for example, e.g., about 6 inches to about 20 inches. In another embodiment, the extension end portion 106 can extend away from the longitudinal portion 104 by, for example, e.g., about 12 inches to about 15 inches. The elongated stand member 101 can include a hook 108 at the end of the extension end portion 106 opposite the longitudinal portion 104. In one embodiment, the hook 108 can be integrally formed with the elongated stand member 101. In another embodiment, the hook can be attached to the extension end portion 106. The hook 108 can be attached to the extension end portion 106, for example, e.g., by being welded, glued, epoxied, threaded into, press fit, etc. The hook 108 can vary in size from being, for example, e.g., the same width as the elongated stand member 101 material to being a wire hook. In one embodiment, the hook 108 can be from, for example, e.g., about a quarter of an inch to about 5 inches wide. In another embodiment, the hook 106 can be, for example, e.g., about 1.5 inches wide.

The plurality of elongated stand members 101 can include a first elongated stand member and a last elongated stand member, with the remaining plurality of elongated stand members 101 being located between the first elongated stand member and the last elongated stand member. Each of the remaining plurality of elongated stand members 101 are attached to adjacent elongated stand members 101 with elongated stand member hinges 110. The elongated stand member hinges 110 permit the plurality of elongated stand members 101 to form the standing or locked position around the central axis 105. The elongated stand member hinges 110 can be located on the longitudinal portion 104 of the elongated stand members 101. Each of the plurality of elongated stand members 101 can include one or more elongated stand member hinges 110. In one embodiment, the elongated stand members 101 include two elongated stand member hinges 110 with one elongated stand member hinge 110 located on the longitudinal portion 104 above the support portion 103 and the other elongated stand member hinge 110 located on the longitudinal portion 104 below the extension end portion 106 of the shorter connected elongated stand member 101. In another embodiment, the elongated stand member hinges 110 are located on the longitudinal portion 104 above the support portion 103 and below the extension end portion 106 of the shortest elongated stand member 101 in the stowable stand 100, so all the upper hinges are adjacently located in the stowable stand 100.

The elongated stand member hinges 110 can include a mechanism to assist in opening or closing the stowable stand 100. In one embodiment, the elongated stand member hinge 110 can include a spring that compresses while the stowable stand 100 is in the locked position, so the stowable stand will close to the folded position when the lock is released (or vice versa). This would also keep the stowable stand 100 in a folded flat position for storage and shipping without more packaging to keep it in the folded position. In another embodiment, the elongated stand member hinge 110 can include a spring that compresses in the folded position to assist in opening the folded stand 100. Two separate elongated stand members can each include a portion of the fastening mechanism that keeps the stowable stand in the locked position.

Figure 2:
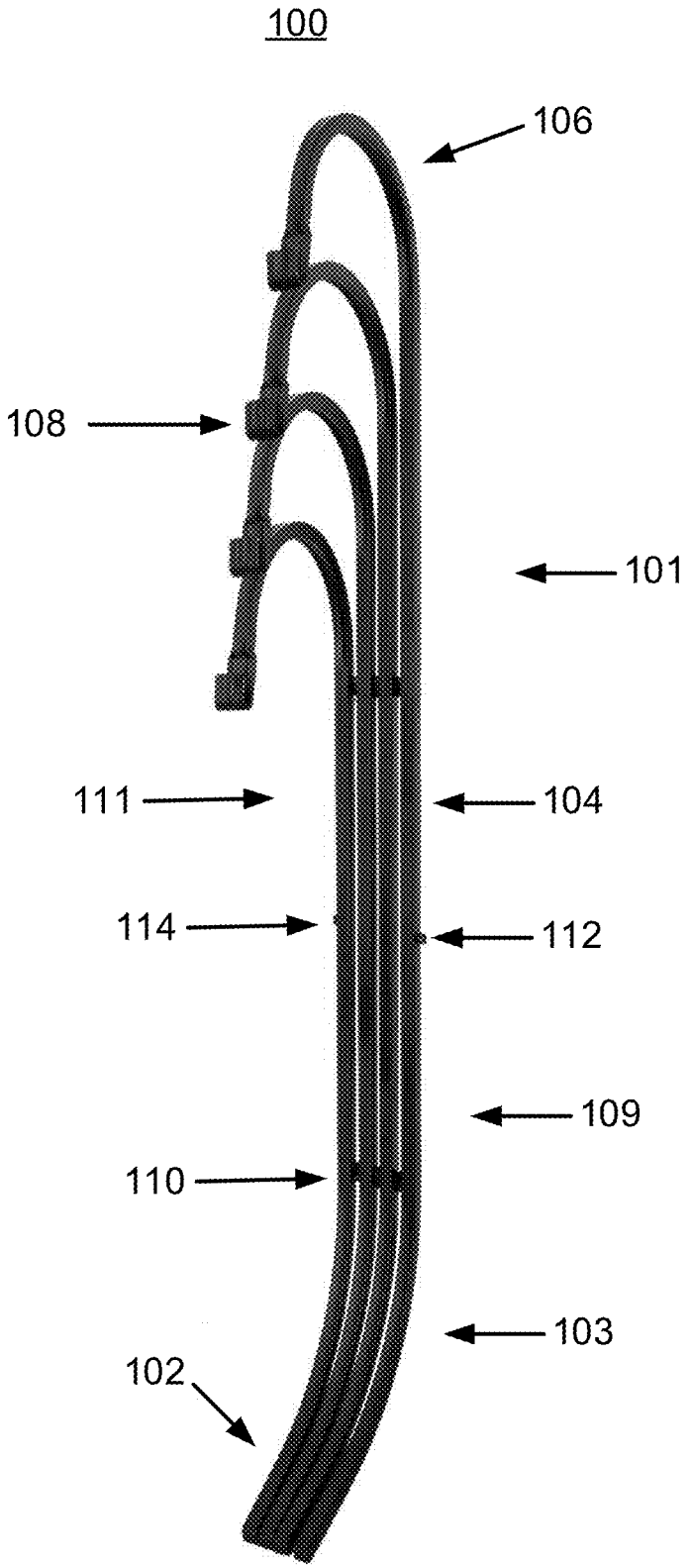
FIG. 2 is a side view of the stowable stand of FIG. 1 showing the stowable stand folded flat in accordance with an embodiment.

Referring now to FIG. 2, illustratively depicts the stowable stand 100 of FIG. 1 showing the stowable stand 100 folded flat in accordance with one embodiment of present invention.

The side view of the stowable stand 100 shows the stowable stand 100 in the folded flat position with four elongated stand members 101, though more and less elongated stand members 101 are contemplated, for example, the stowable stand 100 can include, for example, e.g., three elongated stand members 101, five elongated stand members 101, nine elongated stand members 101, etc. The elongated stand members 101 include the base 102 with the support portion 103 at one end of the base 102. The base 102 in each of the elongated stand members 101 extend from the support portion 103 to form a bottom of the stowable stand 100 when in the locked position. The stowable stand 100 includes two sets of elongated stand member hinges 110 that connect the elongated stand members 101 together to form the stowable stand 100. One of the elongated stand member hinges 110 is located on the longitudinal portion 104 at the end adjacent to the support portion 103. The other one on the elongated stand member hinges 110 is located on the longitudinal portion 104 at the end adjacent to the extension end portion 106 of the elongated stand member 101 with a shortest longitudinal portion 104 among the plurality of elongated stand members 101.

The extension end portion 106 extends from the end of the longitudinal portion 104 opposite the support portion 103. The extension end portion 106 angles away from the longitudinal portion 104. The extension end portion 106 can extend away from the longitudinal portion 104 by, for example, e.g., about 12 inches to about 15 inches. The elongated stand member 101 can include a hook 108 at the end of the extension end portion 106 opposite the longitudinal portion 104. The hook 108 can be integrally formed with the elongated stand member 101.

One of the elongated stand members 101 is the elongated stand member 109. The elongated stand member 109 is only attached to one of the other elongated stand members 101 with elongated stand member hinges 110, while most of the elongated stand members 101 are attached to two other elongated stand members 101. The elongated stand member 109 has a portion of the fastening mechanism attached to the longitudinal portion 104 on the side opposite the elongated stand member hinges 110. In one embodiment, the elongated stand member 109 can include a lower fastener 112. The lower fastener 112 can mate with an upper fastener 114 to form the fastening mechanism. In another embodiment, the elongated stand member 109 can include the upper fastener 114.

The stowable stand 100 can include the elongated stand member 111 on the end opposite of the elongated stand member 109. The elongated stand member 111 is only attached to one of the other elongated stand members 101 with elongated stand member hinges 110, while most of the elongated stand members 101 are attached to two other elongated stand members 101. The elongated stand member 111 has a portion of the fastening mechanism attached to the longitudinal portion 104 on the side opposite the elongated stand member hinges 110. In one embodiment, the elongated stand member 111 can include the lower fastener 112. In another embodiment, the elongated stand member 111 can include the upper fastener 114. The elongated stand member 109 and the elongated stand member 111 can both include either the upper fastener 114 or the lower fastener 112, but the stowable stand 100 will only include one upper fastener 114 and one lower fastener 112.

Figure 3:
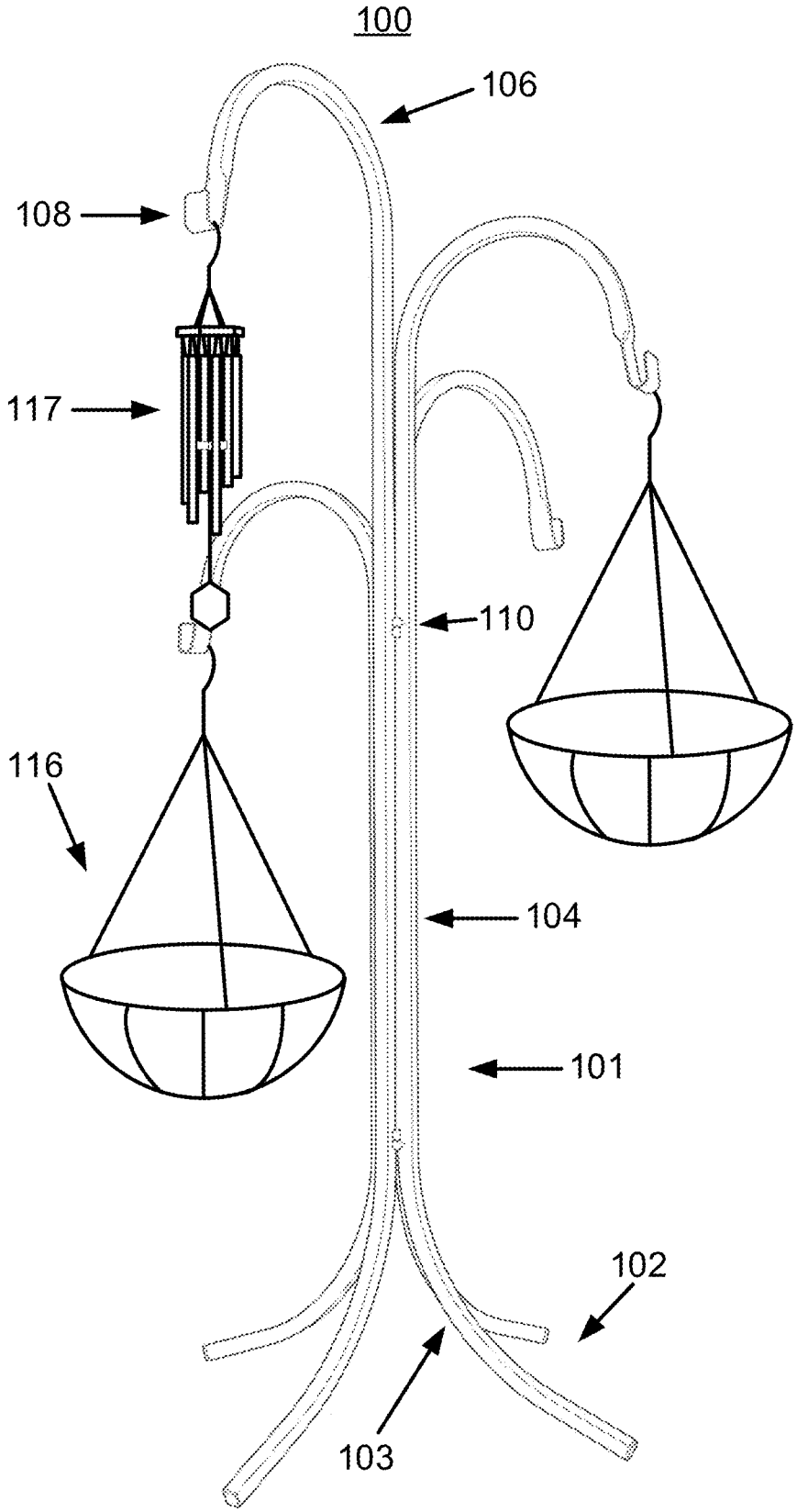
FIG. 3 is a side view of the stowable stand of FIG. 1 showing the stowable stand with baskets in accordance with an embodiment.

Referring now to FIG. 3, illustratively depicts the stowable stand 100 of FIG. 1 showing the stowable stand 100 with baskets 116 in accordance with one embodiment of present invention.

The side view of the stowable stand 100 shows the stowable stand 100 in the locked position with four elongated stand members 101, though more and less elongated stand members 101 are contemplated, for example, the stowable stand 100 can include, for example, e.g., three elongated stand members 101, five elongated stand members 101, nine elongated stand members 101, etc. The elongated stand members 101 include the base 102 with the support portion 103 at one end of the base 102. The base 102 in each of the elongated stand members 101 extend from the support portion 103 to form a bottom of the stowable stand 100 when in the locked position. The stowable stand 100 includes, for example, e.g., two sets of elongated stand member hinges 110 that connect the elongated stand members 101 together to form the stowable stand 100. One of the elongated stand member hinges 110 is located on the longitudinal portion 104 at the end adjacent to the support portion 103. The other one on the elongated stand member hinges 110 is located on the longitudinal portion 104 at the end adjacent to the extension end portion 106 of the elongated stand member 101 with a shortest longitudinal portion 104 among the plurality of elongated stand members 101.

The extension end portion 106 extends from the end of the longitudinal portion 104 opposite the support portion 103. The extension end portion 106 angles away from the longitudinal portion 104. The extension end portion 106 can extend away from the longitudinal portion 104 by about 12 inches to about 15 inches. The elongated stand member 101 can include a hook 108 at the end of the extension end portion 106 opposite the longitudinal portion 104. The hook 108 can be integrally formed with the elongated stand member 101. The hook 108 can support a significant weight of fifty pounds. The hook 108 can support one or more attachments. The attachments can be utilitarian or ornamental. The attachment can be utilitarian, for example, can include, for example, e.g., a hanging basket 116, a coil of rope or wire, a key ring, etc. In one embodiment, the hanging basket 116 can be used to hold flowers. In another embodiment, the hanging basket 116 can be used to hold fruit or vegetable. In another embodiment, the attachments can be ornamental, for example, can include, for example, e.g., a bell, a windchime 117, a string of shells, etc. The attachments on the stowable stand 100 can include a combination of utilitarian attachments and ornamental attachments. In one embodiment, the stowable stand can include hanging baskets 116 and windchimes 117.

Figure 4:
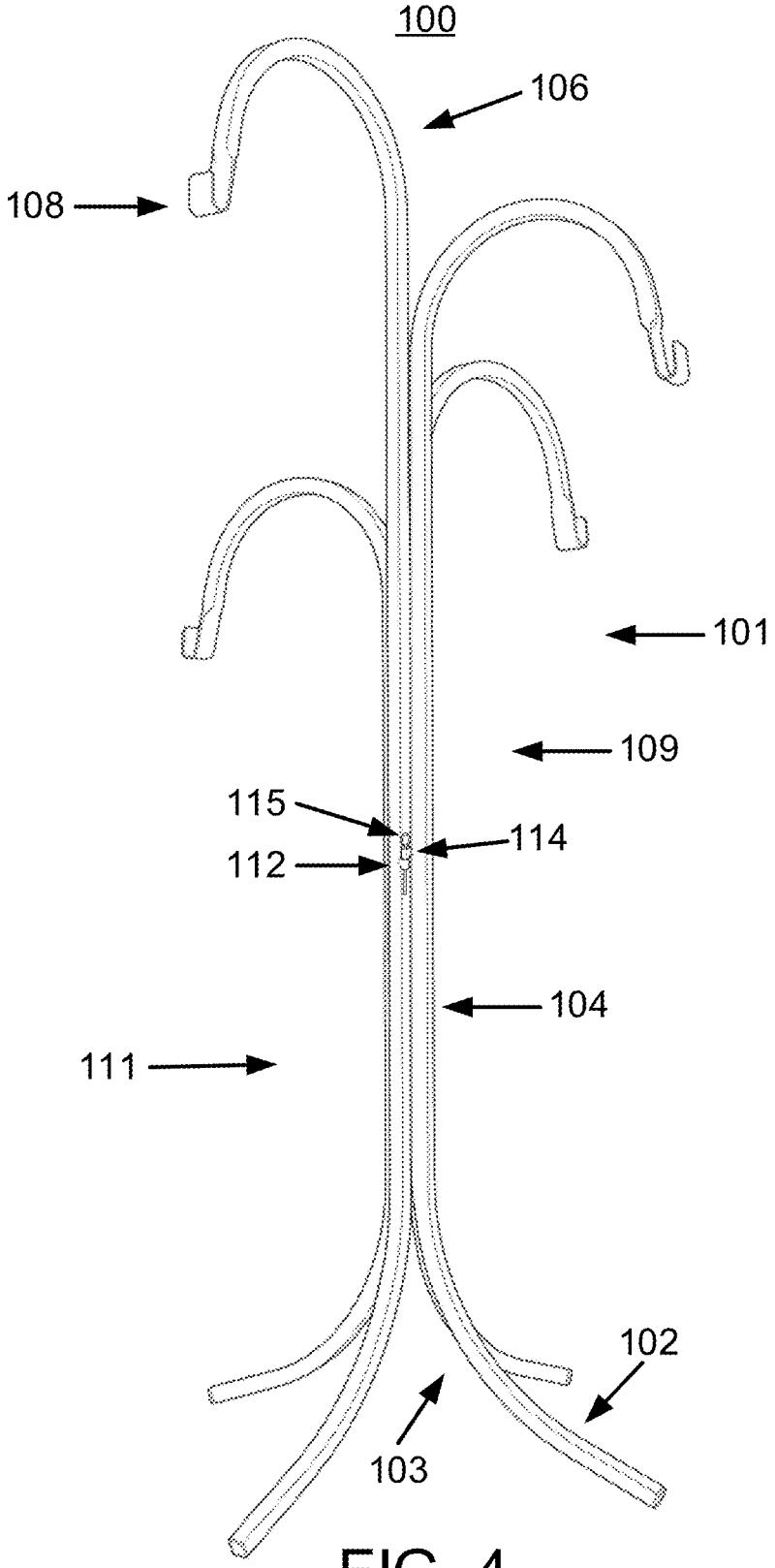
FIG. 4 is a side view of the stowable stand of FIG. 1 showing a side of the stowable stand with a fastening mechanism in accordance with an embodiment.

Referring now to FIG. 4, illustratively depicts the stowable stand 100 of FIG. 1 showing a side of the stowable stand 100 with a fastening mechanism in accordance with another embodiment of present invention.

The side view of the stowable stand 100 shows the stowable stand 100 in the locked position with four elongated stand members 101, though more and less elongated stand members 101 are contemplated, for example, the stowable stand 100 can include, for example, e.g., three elongated stand members 101, five elongated stand members 101, nine elongated stand members 101, etc. The elongated stand members 101 can include the elongated stand member 109 and the elongated stand member 111. The elongated stand members 101 include the base 102 with the support portion 103 at one end of the base 102. The base 102 in each of the elongated stand members 101 extend from the support portion 103 to form a bottom of the stowable stand 100 when in the locked position. The longitudinal portion 104 extends away from the support portion 103. The extension end portion 106 extends from the end of the longitudinal portion 104 opposite the support portion 103. The extension end portion 106 angles away from the longitudinal portion 104. The extension end portion 106 can extend away from the longitudinal portion 104 by, for example, e.g., about 12 inches to about 15 inches. The elongated stand member 101 can include a hook 108 at the end of the extension end portion 106 opposite the longitudinal portion 104. The hook 108 can be integrally formed with the extension end portion 106.

The longitudinal portion 104 of the elongated stand member 109 and the longitudinal portion 104 of the elongated stand member 111 can include portions of the fastening mechanism. In one embodiment, the elongated stand member 109 can include a lower fastener 112. The lower fastener 112 can mate with an upper fastener 114 to form the fastening mechanism. In another embodiment, the elongated stand member 109 can include the upper fastener 114. The elongated stand member 111 can include the portion of the locking mechanism that is not included on the elongated stand member 109. When the elongated stand member 109 includes the upper fastener 114 then the elongated stand member 111 can include the lower fastener 112. When the elongated stand member 109 includes the lower fastener 112 then the elongated stand member 111 can include the upper fastener 114.

The fastening mechanism locks with a locking structure. The locking structure can be integrated into the upper fastener 114, the lower fastener 112, or both the upper fastener 114 and the lower fastener 112. The locking structure can be separate from both the upper fastener 114 and the lower fastener 112. In one embodiment, the locking structure can include a removable locking pin 115. The locking pin 115 can be inserted into through the upper fastener 114 and the lower fastener 112 when the upper fastener 114 and the lower fastener 112 are aligned. The removable locking pin 115 can include a ring at one end to keep the removable locking pin 115 from falling through the upper fastener 114 and the lower fastener 112. In another embodiment, the locking structure can be integrated, for example, e.g., a spring-loaded ball bearing, a sliding pin with latch, etc. Other locking structures are also contemplated, for example, e.g., a cotter pin or key, a flattop pin, a ring, etc.

Figure 5:
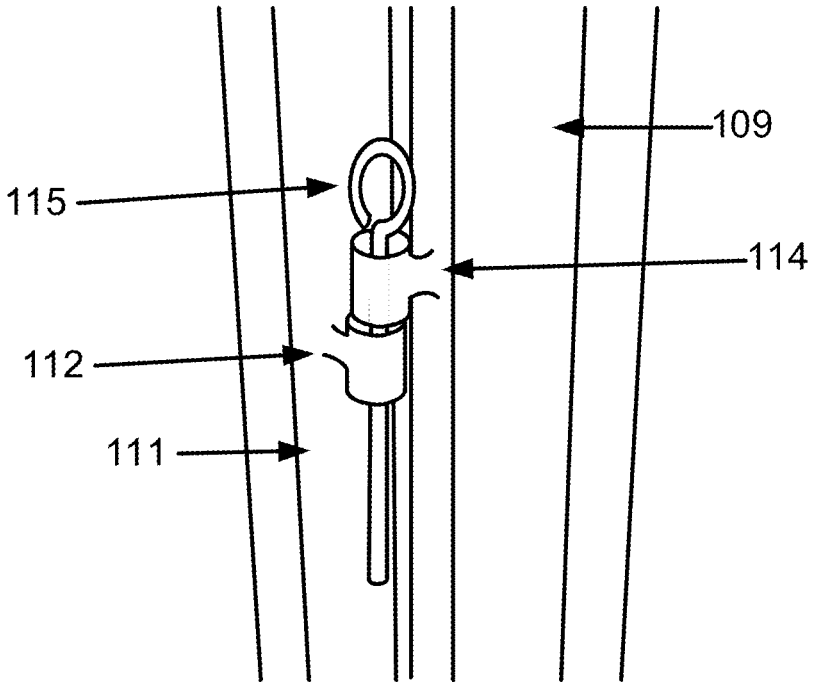
FIG. 5 is a view of the fastening mechanism in FIG. 4 with a removable locking pin in accordance with an embodiment.

Referring now to FIG. 5, illustratively depicts the fastening mechanism in FIG. 4 with a removable locking pin 115 in accordance with another embodiment of present invention.

The elongated stand member 109 can include a portion of the fastening mechanism. The elongated stand member 109 can include the upper fastener 114. The upper fastener 114 can mate with the lower fastener 112 when the stowable stand 100 is in the open position. The elongated stand member 111 can include the lower fastener 112 that can be located below the upper fastener 114 when the elongated stand member 109 and the elongated stand member 111 are adjacent to each other when the stowable stand 100 is in the open position.

The stowable stand 100 can be locked when the locking structure is utilized in the fastening mechanism. The locking structure can include the removable locking pin 115. The removable locking pin 115 can be inserted into the upper fastener 114, then slid down through the lower fastener 112. The removable locking pin 115 can include the ring at one end of the removable locking pin 115 to keep the removable locking pin 115 from falling through the upper fastener 114 and the lower fastener 112.

Figure 6:
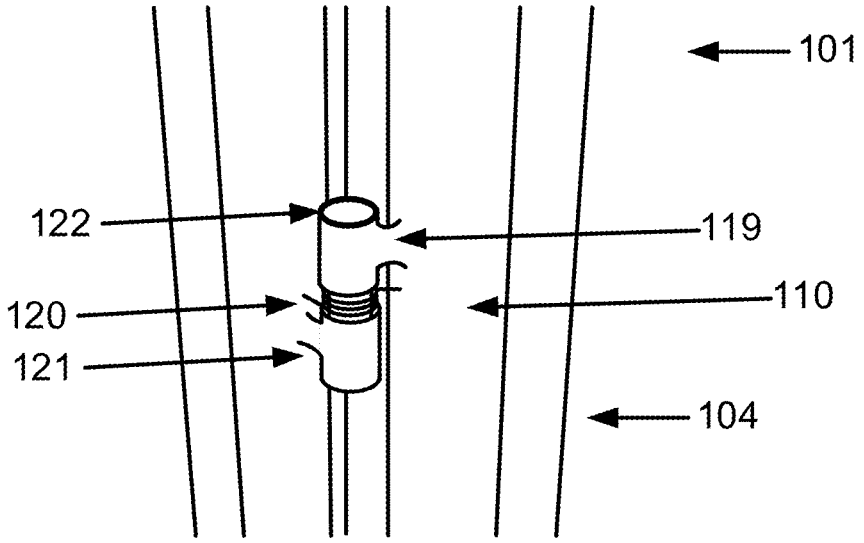
FIG. 6 is a view of a hinge with a spring closer in accordance with another embodiment.

Referring now to FIG. 6, illustratively depicts an elongated stand member hinge 110 with a spring closer 120 in accordance with another embodiment of present invention.

The elongated stand members 101 can include an elongated stand member hinge 110. A lower portion 121 of the elongated stand member hinge 110 can be attached to one of the plurality of elongated stand members 101 in the stowable stand 100 and the upper portion 119 of the hinge 100 can be attached to one of the plurality of elongated stand members 100 adjacent to the elongated stand member 101 with the lower portion 121 of the elongated stand member hinge 110. The elongated stand member hinge 110 can include closing features or opening features. The opening features and closing features can include the coil spring 120, a flat spring, a machines spring, a pneumatic arm, etc. In one embodiment, the closing features can include the coil spring 120. The coil spring 120 can be positioned between the upper portion 119 and the lower portion 121 around a hinge pin 122. The hinge pin 122 can pass from the top of the upper portion 119 through the coil spring 120 into the lower portion 121. The coil spring 120 can extend to contact the elongated stand members 101 and compress when the stowable stand 100 is in the open or locked position. The compressed coil spring 120 can assist in the closing of the stowable stand 100 and keeping the stowable stand in the folded position.

In another embodiment, the opening features can include the coil spring 120. The coil spring 120 can be positioned between the upper portion 119 and the lower portion 121 around a hinge pin 122. The hinge pin 122 can pass from the top of the upper portion 119 through the coil spring 120 into the lower portion 121. The coil spring 120 can extend to contact the elongated stand members 101 and compress when the stowable stand 100 is in the folded position. The compressed coil spring 120 can assist in the opening of the stowable stand 100 and keeping the stowable stand in the open position.

Figure 7:
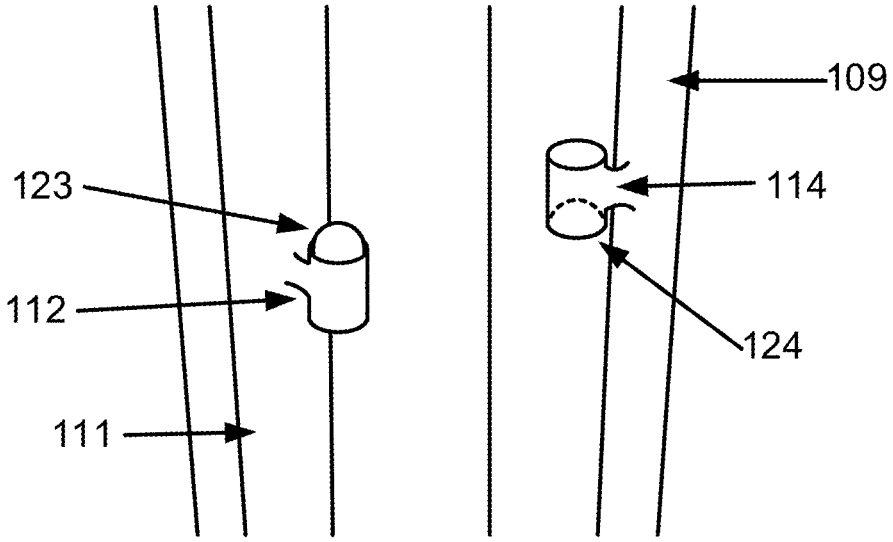
FIG. 7 is a view of a fastening mechanism with a spring-loaded ball bearing that is open in accordance with another embodiment.

Referring now to FIG. 7, illustratively depicts a fastening mechanism with a spring-loaded ball bearing 123 that is open in accordance with another embodiment of present invention.

The elongated stand member 109 can include a portion of the fastening mechanism. The elongated stand member 109 can include the upper fastener 114. The upper fastener 114 can mate with the lower fastener 112 when the stowable stand 100 is in the open position. The elongated stand member 111 can include the lower fastener 112 that can be located below the upper fastener 114 when the elongated stand member 109 and the elongated stand member 111 are adjacent to each other when the stowable stand 100 is in the open position.

The stowable stand 100 can be locked when the locking structure is engaged in the fastening mechanism. The locking structure can include the spring-loaded ball bearing 123. The spring-loaded ball bearing 123 can be included in the lower fastener 112 or the upper fastener 114. The portion of the fastening mechanism that does not include the spring-loaded ball bearing 123, either the upper fastener 114 or the lower fastener 112, can include a ball socket 124 that accepts the spring-loaded ball bearing 123 when in the stowable stand 100 is in the open or locked position. In one embodiment, the locking structure includes the spring-loaded ball bearing 123 located in the lower fastener 112 and the ball socket 124 in the upper fastener 114. In another embodiment, the locking structure includes the spring-loaded ball bearing 123 located in the upper fastener 114 and the ball socket 124 in the lower fastener 112.

Figure 8:
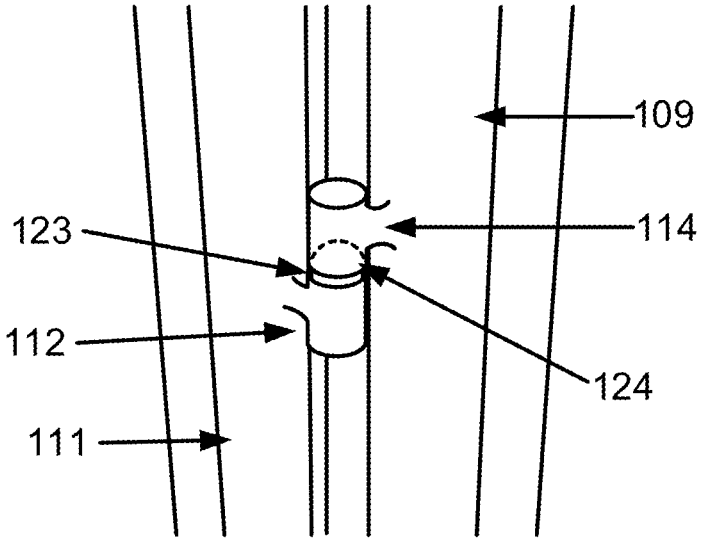
FIG. 8 is a view of the fastening mechanism in FIG. 7 in the locked position in accordance with another embodiment.

Referring now to FIG. 8, illustratively depicts the fastening mechanism in FIG. 7 in the locked position in accordance with another embodiment of present invention.

The elongated stand member 109 can be brought adjacent to the elongated stand member 111 aligning the upper fastener 114 and the lower fastener 112. In one embodiment, aligning the upper fastener 114 with the lower fastener 112 can push the spring-loaded ball bearing 123 down into the lower fastener 112 compressing the spring. The spring will seat the spring-loaded ball bearing 123 into the ball socket 124 of the upper fastener 114 as the spring uncompresses when the upper fastener 114 and lower fastener 112 align.

The fastening mechanism with the spring-loaded ball bearing 123 seated in the ball socket 124 in the upper fastener 114 is in the locked position.

In another embodiment, aligning the upper fastener 114 with the lower fastener 112 can push the spring-loaded ball bearing 123 up into the upper fastener 114 compressing the spring. The spring will seat the spring-loaded ball bearing 123 into the ball socket 124 of the lower fastener 112 as the spring uncompresses when the upper fastener 114 and lower fastener 112 align. The fastening mechanism with the spring-loaded ball bearing 123 seated in the ball socket 124 in the lower fastener 112 is in the locked position.

Figure 9:
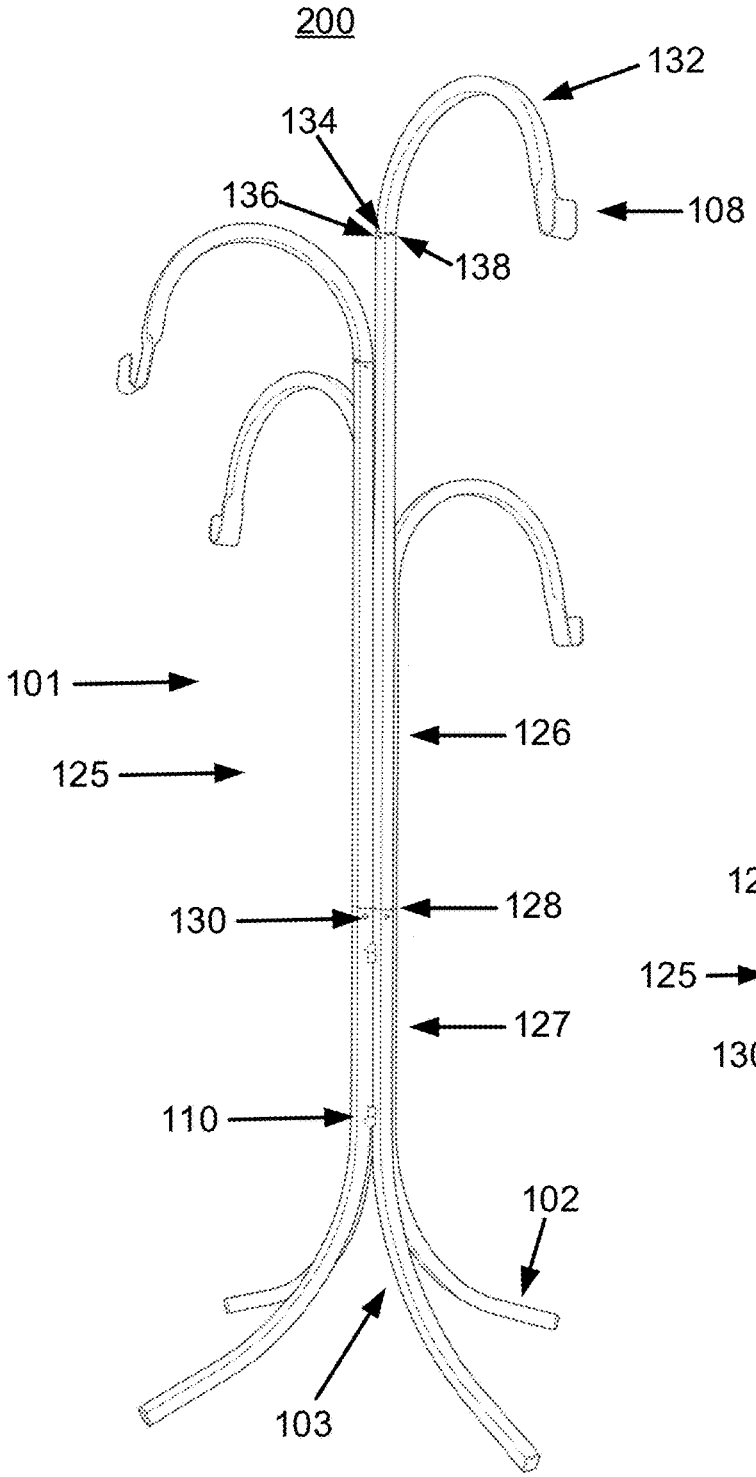
FIG. 9 is a side view of a collapsible stowable stand with folding arms and collapsing body in accordance with another embodiment.

Referring now to FIG. 9, illustratively depicts a collapsible stowable stand 200 with folding extension end portions 132 and extending longitudinal portions 125 in accordance with another embodiment of present invention is illustratively depicted.

According to aspects of the present embodiment, the collapsible stowable stand 200 can include a plurality of elongated stand members 101. In one embodiment, the collapsible stowable stand 200 can include four elongated stand members 101. In other embodiments, the collapsible stowable stand 200 can include, for example, e.g., three elongated stand members 101, five elongated stand members 101, six elongated stand members 101, seven elongated stand members 101, etc. The elongated stand members 101 can be constructed from a tubular material or a combination of tubular and solid materials. In one embodiment, the elongated stand members 101 can include a tubular construction with a square cross section. In another embodiment, the elongated stand members 101 can include other tubular cross sections, for example, e.g., a circular cross section, an octagonal cross section, a hexagonal cross section, etc. Portions of the elongated stand members 101 can be constructed of solid material with varying cross sections, for example, e.g., a solid square cross section, a solid circular cross section, a solid square twisted cross section, etc. The elongated stand members 101 can include a support portion 103 near one end of the elongated stand member 101. In one embodiment, the support portion 103 can be a gentle extension end portion away from the elongated stand member 101. In other embodiments, the support portion 103 can include a sharp corner, for example, the corner being from, for example, e.g., about 15 degrees to about 75 degrees. The elongated stand member 101 can include a base 102 extending from the support portion 103.

The base 102 extends away from the support portion 103 to support the collapsible stowable stand 200 and keep the collapsible stowable stand 200 in the upright position. In one embodiment, the base 102 can extend away from the support portion 103 from, for example, e.g., about 4 inches to about 24 inches. In another embodiment, the base 102 can extend away from the support portion 103 for, for example, e.g., about 10 inches to about 14 inches. The elongated stand member 101 can include the extending longitudinal portion 125 extending from the support portion 101 opposite the base 102. In one embodiment, the extending longitudinal portion 125 can extend from the support portion 103 from, for example, e.g., about 15 inches to about 100 inches. In another embodiment, the extending longitudinal portion 125 can extend from, the support portion 103 from, for example, e.g., about 30 inches to about 60 inches. Each of the plurality of elongated stand members 101 in the collapsible stowable stand 200 can include the extending longitudinal portion 125 of different lengths. In one embodiment, the extending longitudinal portion 125 of each of the plurality of elongated stand members 101 extends, for example, e.g., about 10 inches further from the support portion 103 as the previous elongated stand member 101.

The extending longitudinal portion 125 can include a lower longitudinal portion 127 and an upper longitudinal portion 126. The lower longitudinal portion 127 can extend from the support portion 103 to the longitudinal portion socket 128. The upper longitudinal portion 126 can fit into the longitudinal portion socket 128 and slide down into the lower longitudinal portion 127. The upper longitudinal portion 126 can lock into the lower longitudinal portion 127 with a longitudinal portion lock. The adjustability of moving the upper longitudinal portion 126 into the lower longitudinal portion 127 permits the extending longitudinal portion 125 to adjust to the needs of the user and application of the collapsible stowable stand 200. The longitudinal portion lock can include different mechanisms to lock the upper longitudinal portion 126 into the lower longitudinal portion 127, for example, e.g., a set screw 130, a cotter pin or key, a spring-loaded ball bearing 123, a pressure latch, etc. In one embodiment, the upper longitudinal portion 126 can be positioned in the lower longitudinal portion 127 and locked into place with the set screw 130, keeping the extending longitudinal portion 127 at the length the user needs.

The elongated stand member 101 can include a folding extension end portion 132 at the end of the extending longitudinal portion 125 opposite the support portion 103. The folding extension end portion can attach to the extending longitudinal portion 125 at the extension end portion socket 134 with an extension end portion hinge 138. The extension end portion hinge 138 permits the folding extension end portion 132 to fold down for shipping and storage. The folding extension end portion 132 can lock into an upright position with an extension end portion lock. The extension end portion lock can include different mechanisms to lock the folding extension end portion 132 into the upright position, for example, e.g., a lock screw 136, a cotter pin or key, a spring-loaded ball bearing 123, a pressure latch, etc. In one embodiment, the folding extension end portion 132 is locked into position with the set screw 130, keeping the folding extension end portion upright for usage by the user. The folding extension end portion 132 can extend in the same direction away from the longitudinal portion as the support portion 103. The folding extension end portion 132 can extension end portion from, for example, e.g., about 150 degrees to about 180 degrees from the longitudinal portion. In one embodiment, the folding extension end portion 132 can extend away from the extending longitudinal portion 125 by, for example, e.g., about 6 inches to about 20 inches. In another embodiment, the folding extension end portion 132 can extend away from the extending longitudinal portion 125 by, for example, e.g., about 12 inches to about 15 inches.

The elongated stand member 101 can include a hook 108 at the end of the folding extension end portion 132 opposite the extending longitudinal portion 125. In one embodiment, the hook 108 can be integrally formed with the elongated stand member 101. In another embodiment, the hook can be attached to the folding extension end portion 132. The hook 108 can be attached to the folding extension end portion 132, for example, by being, for example, e.g., welded, glued, epoxied, threaded into, press fit, etc. The hook 108 can vary in size from being, for example, e.g., the same width as the elongated stand member 101 material to being a wire hook 108. In one embodiment, the hook 108 can be from, for example, e.g., about a quarter of an inch to about 5 inches wide. In another embodiment, the hook 108 can be, for example, e.g., about 1.5 inches wide.

The plurality of elongated stand members 101 can include a first elongated stand member and a last elongated stand member, with the remaining plurality of elongated stand members 101 being located between the first elongated stand member and the last elongated stand member. Each of the remaining plurality of elongated stand members 101 are attached to adjacent elongated stand members 101 with elongated stand member hinges 110. The elongated stand member hinges 110 can be located on the lower longitudinal portion 127 of the elongated stand members 101. Each of the plurality of elongated stand members 101 can include one or more elongated stand member hinges 110. In one embodiment, the elongated stand members 101 include two elongated stand member hinges 110 with one elongated stand member hinge 110 located on the lower longitudinal portion 127 above the support portion 103 and the other elongated stand member hinge 110 located on the lower longitudinal portion 127 below longitudinal portion socket 128. The elongated stand member hinges 110 can include a mechanism to assist in opening or closing the collapsible stowable stand 200. In one embodiment, the elongated stand member hinge 110 can include a spring that compresses while the collapsible stowable stand 200 is in the locked position, so the stowable stand will close to the folded position when the lock is released. This would also keep the collapsible stowable stand 200 in a folded flat position for storage and shipping without more packaging to keep it in the folded position. In another embodiment, the elongated stand member hinge 110 can include a spring that compresses in the folded position to assist in opening the folded stand 100. The first elongated stand member and the last elongated stand member each include a portion of the fastening mechanism that keeps the collapsible stowable stand 200 in the locked position.

Figure 10:
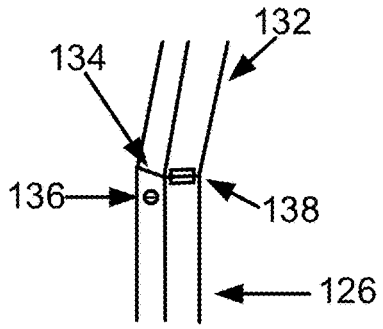
FIG. 10 is a view of the folding arm in FIG. 9 with a hinge and a locking mechanism in accordance with another embodiment.

Referring now to FIG. 10, illustratively depicts the folding extension end portion 132 in FIG. 9 with the extension end portion hinge 138 and the extension end portion lock in accordance with another embodiment of present invention.

The upper longitudinal portion 126 can include the extension end portion socket 134. The extension end portion sockets 134 accepts the folding extension end portion 132 when the folding extension end portion 132 is in the upright position. The folding extension end portion 132 can be attached to the upper longitudinal portion 126 with the extension end portion hinge 138. The extension end portion hinge 138 permits the folding extension end portion 132 to fold down for shipping and storage. The folding extension end portion 132 can lock into an upright position with an extension end portion lock. The extension end portion lock can include different mechanisms to lock the folding extension end portion 132 into the upright position, for example, e.g., a lock screw 136, a cotter pin or key, a spring-loaded ball bearing 123, a pressure latch, etc. In one embodiment, the folding extension end portion 132 is locked into position with the set screw 130, keeping the folding extension end portion upright for usage by the user.

Figure 11:
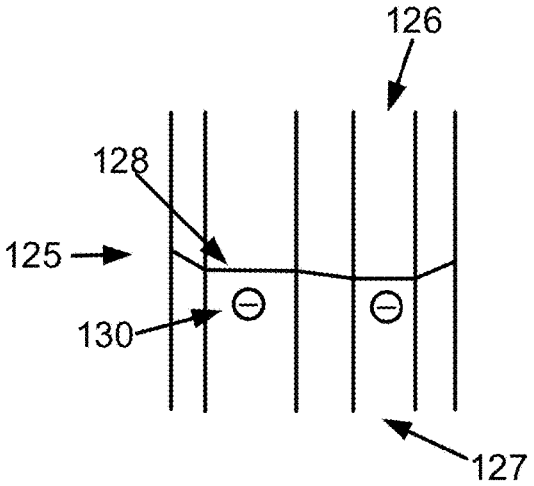
FIG. 11 is a view of the extending longitudinal portion in FIG. 9 with the longitudinal portion lock in accordance with another embodiment.

Referring now to FIG. 11, illustratively depicts the extending longitudinal portion 125 in FIG. 9 with the longitudinal portion lock in accordance with another embodiment of present invention.

The extending longitudinal portion 125 can include a lower longitudinal portion 127 and an upper longitudinal portion 126. The lower longitudinal portion 127 can include the longitudinal portion socket 128 that can accept the upper longitudinal portion 126. The upper longitudinal portion 126 can fit into the longitudinal portion socket 128 and slide down into the lower longitudinal portion 127. The upper longitudinal portion 126 can lock into the lower longitudinal portion 127 with the longitudinal portion lock. The adjustability of moving the upper longitudinal portion 126 into the lower longitudinal portion 127 permits the extending longitudinal portion 125 to adjust to the needs of the user and application of the collapsible stowable stand 200. The longitudinal portion lock can include different mechanisms to lock the upper longitudinal portion 126 into the lower longitudinal portion 127, for example, e.g., a set screw 130, a cotter pin or key, a spring-loaded ball bearing 123, a pressure latch, etc. In one embodiment, the upper longitudinal portion 126 can be positioned in the lower longitudinal portion 127 and locked into place with the set screw 130, keeping the extending longitudinal portion 127 at the length the user needs.

Figure 12:
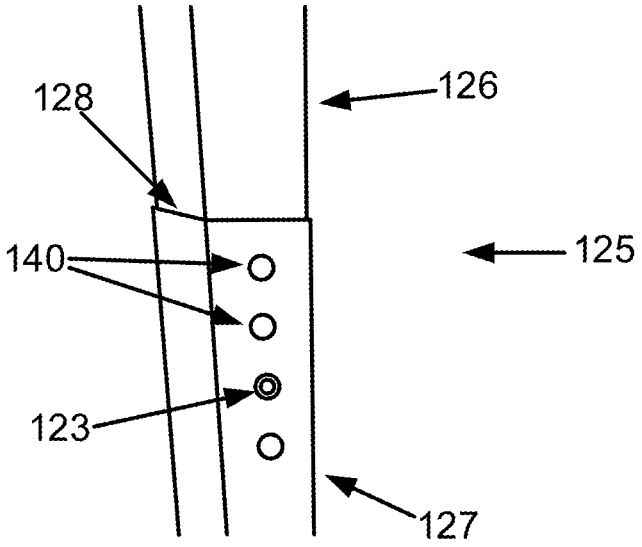
FIG. 12 is a view of the extending longitudinal portion with a longitudinal portion lock in accordance with another embodiment.

Referring now to FIG. 12, illustratively depicts the extending longitudinal portion 125 with the longitudinal portion lock in accordance with another embodiment of present invention.

The extending longitudinal portion 125 can include a lower longitudinal portion 127 and an upper longitudinal portion 126. The lower longitudinal portion 127 can include the longitudinal portion socket 128 that can accept the upper longitudinal portion 126. The upper longitudinal portion 126 can fit into the longitudinal portion socket 128 and slide down into the lower longitudinal portion 127. The upper longitudinal portion 126 can lock into the lower longitudinal portion 127 with the longitudinal portion lock. The adjustability of moving the upper longitudinal portion 126 into the lower longitudinal portion 127 permits the extending longitudinal portion 125 to adjust to the needs of the user and application of the collapsible stowable stand 200. The longitudinal portion lock can include different mechanisms to lock the upper longitudinal portion 126 into the lower longitudinal portion 127, for example, e.g., the set screw 130, a cotter pin or key, the spring-loaded ball bearing 123, a pressure latch, etc. In one embodiment, the upper longitudinal portion 126 can be positioned in the lower longitudinal portion 127 and locked into place with the spring-loaded ball bearing 123, keeping the extending longitudinal portion 127 at the length the user needs. The lower longitudinal portion 127 can include a plurality of bearing sockets 140. The bearing sockets 140 can be spaced along the lower longitudinal portion 127 giving a user the ability to adjust the height of the extending longitudinal portion 125 in increments. The spring-loaded ball bearing 123 can seat into the bearing socket 140 locking the upper longitudinal portion 126 to the lower longitudinal portion 127.

Figure 13:
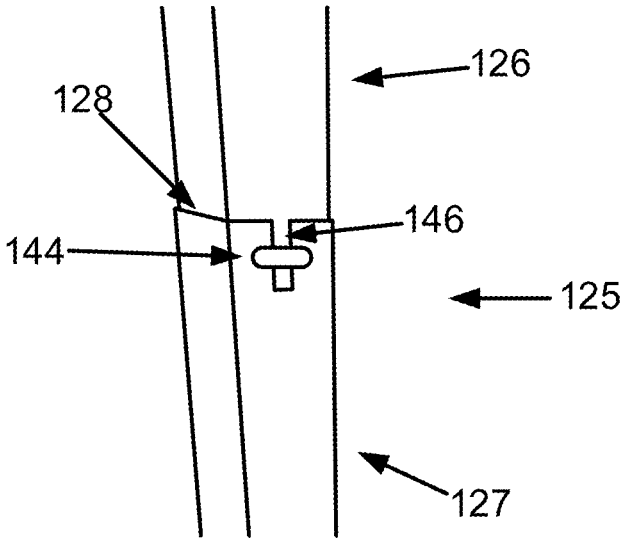
FIG. 13 is a view of the extending longitudinal portion with a longitudinal portion lock in accordance with another embodiment.

Referring now to FIG. 13, illustratively depicts the extending longitudinal portion 125 with the longitudinal portion lock in accordance with another embodiment of present invention.

The extending longitudinal portion 125 can include a lower longitudinal portion 127 and an upper longitudinal portion 126. The lower longitudinal portion 127 can include the longitudinal portion socket 128 that can accept the upper longitudinal portion 126. The upper longitudinal portion 126 can fit into the longitudinal portion socket 128 and slide down into the lower longitudinal portion 127. The upper longitudinal portion 126 can lock into the lower longitudinal portion 127 with the longitudinal portion lock. The adjustability of moving the upper longitudinal portion 126 into the lower longitudinal portion 127 permits the extending longitudinal portion 125 to adjust to the needs of the user and application of the collapsible stowable stand 200. The longitudinal portion lock can include different mechanisms to lock the upper longitudinal portion 126 into the lower longitudinal portion 127, for example, e.g., the set screw 130, a cotter pin or key, the spring-loaded ball bearing 123, a pressure latch 144, etc. In one embodiment, the upper longitudinal portion 126 can be positioned in the lower longitudinal portion 127 and locked into place with the pressure latch 144, keeping the extending longitudinal portion 127 at the length the user needs. The lower longitudinal portion 127 can include a latch gap 146. The latch gap 146 permits the pressure latch 144 to squeeze the upper longitudinal portion 126 with the lower longitudinal portion 127, locking the upper longitudinal portion 126 into an extended position.

Figure 14:
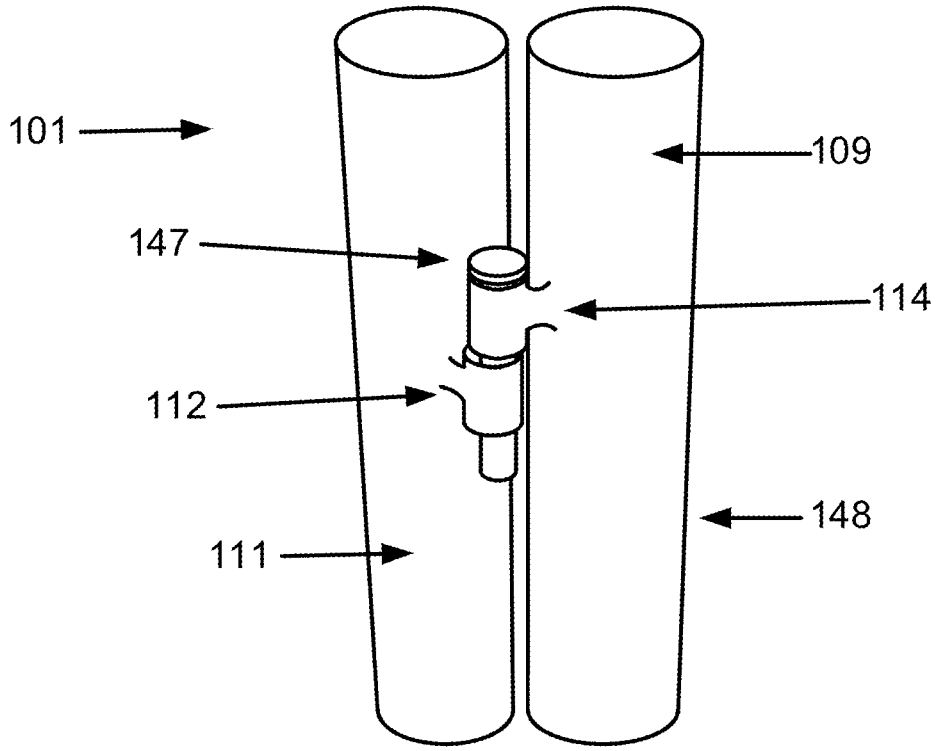
FIG. 14 is a view of the fastening mechanism with a flattop pin in accordance with another embodiment.

Referring now to FIG. 14, illustratively depicts the fastening mechanism with a flattop pin 147 in accordance with another embodiment of present invention.

The elongated stand members 101 can be constructed from a solid material or tubular material. In one embodiment, the elongated stand members 101 can include a tubular construction with a round cross section 148. The elongated stand members can include the elongated stand member 109 and the elongated stand member 111. The elongated stand member 109 can include a portion of the fastening mechanism. The elongated stand member 109 can include the upper fastener 114. The upper fastener 114 can mate with the lower fastener 112 when the stowable stand 100 is in the open position. The elongated stand member 111 can include the lower fastener 112 that can be located below the upper fastener 114 when the elongated stand member 109 and the elongated stand member 111 are adjacent to each other when the stowable stand 100 is in the open position.

The stowable stand 100 can be locked when the locking structure is utilized in the fastening mechanism. The locking structure can include the flattop pin 147. The flattop pin 147 can be inserted into the upper fastener 114, then slid down through the lower fastener 112. The flattop pin 147 can include a flattop at one end of the flattop pin 147 that is larger than the pin portion to keep the flattop pin 147 from falling through the upper fastener 114 and the lower fastener 112.

Figure 15:
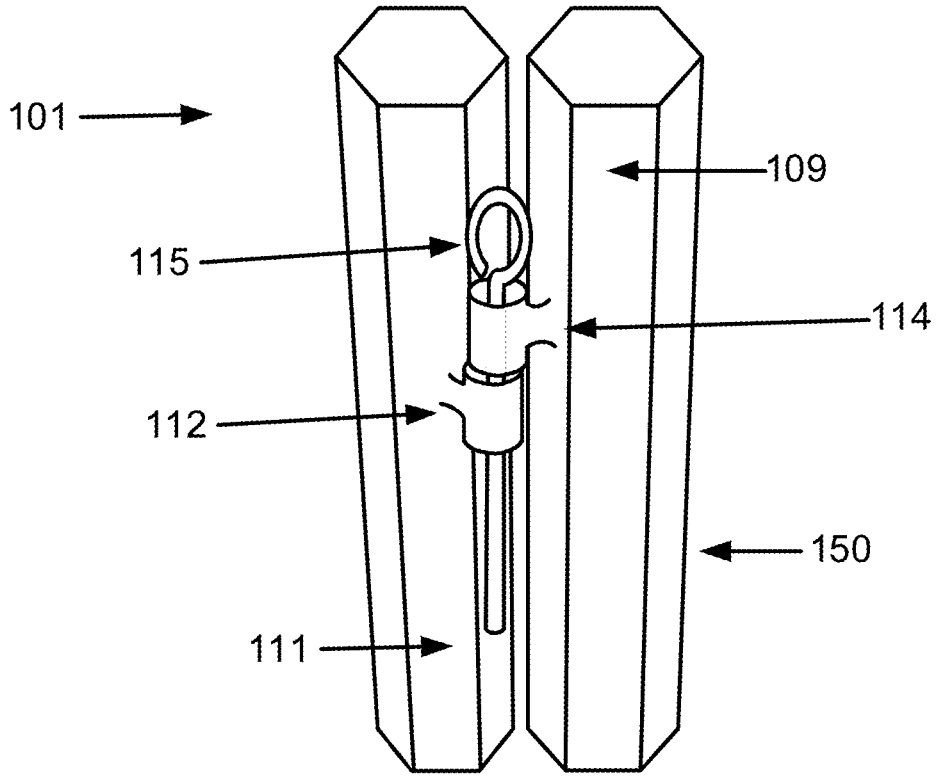
FIG. 15 is a view of the fastening mechanism with a removable locking pin in accordance with another embodiment.

Referring now to FIG. 15, illustratively depicts the fastening mechanism with a removable locking pin in accordance with another embodiment of present invention.

The elongated stand members 101 can be constructed from a solid material or tubular material. In one embodiment, the elongated stand members 101 can include a tubular construction with a hexagonal cross section 150. The elongated stand members can include the elongated stand member 109 and the elongated stand member 111. The elongated stand member 109 can include a portion of the fastening mechanism. The elongated stand member 109 can include the upper fastener 114. The upper fastener 114 can mate with the lower fastener 112 when the stowable stand 100 is in the open position. The elongated stand member 111 can include the lower fastener 112 that can be located below the upper fastener 114 when the elongated stand member 109 and the elongated stand member 111 are adjacent to each other when the stowable stand 100 is in the open position.

The stowable stand 100 can be locked when the locking structure is utilized in the fastening mechanism. The locking structure can include the removable locking pin 115. The removable locking pin 115 can be inserted into the upper fastener 114, then slid down through the lower fastener 112. The removable locking pin 115 can include the ring at one end of the removable locking pin 115 to keep the removable locking pin 115 from falling through the upper fastener 114 and the lower fastener 112.

Having described preferred embodiments for stowable stands (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is desired to be protected by Letters Patent is set forth.

What is claimed is:

1. A stowable stand, comprising:

three or more elongated stand members, the stand members having a shape to permit nesting in a two-dimensional configuration, each stand member including an extension end portion extending from a corresponding longitudinal portion, the longitudinal portions being hingedly connected, using one or more hinge structures comprising two or more connectable portions, to at least one other longitudinal portion to enable the elongated stand members to be folded flat into a stowable position in the two-dimensional configuration; and each stand member including a support portion extending from the longitudinal portion on an end opposite the extension end portion, the support portions collectively forming a support stand to support the stowable stand when the elongated stand members are in a standing position.

2. The stowable stand of claim 1, wherein the extension end portion extends away from the elongated stand member perpendicularly relative to a central axis.

3. The stowable stand of claim 1, wherein the extension end portion is monolithically constructed with each of the three or more elongated stand members.

4. The stowable stand of claim 1, wherein the three or more elongated stand members are locked together with a locking mechanism in the standing position.

5. The stowable stand of claim 4, wherein the locking mechanism includes a locking pin.

6. The stowable stand of claim 1, wherein the extension end portion includes a hook.

7. The stowable stand of claim 1, wherein the support stand includes equivalent spacing between the support portions.

8. The stowable stand of claim 1, wherein each of the three or more elongated stand members are different heights.

9. The stowable stand of claim 7, wherein the height of a subsequent elongated stand member of the three or more stand members increases compared to a previous elongated stand member of the three or more stand members.

10. The stowable stand of claim 1, wherein the longitudinal portions are hingedly connected such that the support portions form the support stand in a plane perpendicular to a central axis of the stowable stand.

11. The stowable stand of claim 1, wherein the extension end portions are configured to counter balance weight applied to any opposite extension end portion while in the standing position.

12. The stowable stand of claim 1, wherein the three or more elongated stand members are constructed of a tubular material.

13. A stowable stand, comprising:

three or more stand members extending away from a central axis ending in a hook, each of the three or more stand members including a base extension at the end opposite the hook;

a link that connects each of the three or more stand members to at least one other of the three or more stand members, the link being a hinge structure comprising two or more connectable portions;

a locking mechanism configured for locking two or more of the three or more stand members together to keep the stowable stand in a locked state; and the base extensions collectively forming a stand base to support the stowable stand when the stand members are in the locked state.

14. The stowable stand of claim 13, wherein the stand base maintains the stowable stand in an upright position to a plane perpendicular to the central axis.

15. The stowable stand of claim 13, wherein the locking mechanism includes a locking pin.

16. The stowable stand of claim 13, wherein each of the three or more stand members are different heights.

17. The stowable stand of claim 13, wherein the stowable stand folds flat when the three or more stand members are not in a locked state.

18. The stowable stand of claim 13, wherein each subsequent stand member of the three or more stand members is longer than each previous stand member of the three or more stand members.

19. The stowable stand of claim 13, wherein the three or more stand members are constructed of a tubular material.

20. A stowable stand, comprising:

three or more extendible elongated stand members, the stand members having a shape to permit nesting in a two dimensional configuration, each stand member including a foldable extension end portion extending from a corresponding extendible longitudinal portion, the extendible longitudinal portion being extendible from a fixed longitudinal portion, the fixed longitudinal portions being hingedly connected, using one or more hinge structures comprising two or more connectable portions, to at least one other fixed longitudinal portion to enable the extendible elongated stand members to be folded flat into a stowable position in the two dimensional configuration; and each stand member including a support portion extending from the fixed longitudinal portion on an end opposite the extendible longitudinal portion, the support portions collectively forming a support stand to support the stowable stand when the extendible elongated stand members are in a standing position.

* * * * *